US008484792B2

(12) United States Patent
Konishi et al.

(10) Patent No.: US 8,484,792 B2
(45) Date of Patent: Jul. 16, 2013

(54) CLEANING TOOL

(75) Inventors: Takayoshi Konishi, Kagawa (JP); Hideaki Ichiura, Ehime (JP); Masaaki Morikawa, Ehime (JP); Masaki Takahashi, Ehime (JP); Noriyoshi Nishida, Ehime (JP)

(73) Assignee: Unicharm Corporation, Ehime (JP)

( * ) Notice: Subject to any disclaimer, the term of this patent is extended or adjusted under 35 U.S.C. 154(b) by 357 days.

(21) Appl. No.: 12/679,951

(22) PCT Filed: Sep. 24, 2008

(86) PCT No.: PCT/JP2008/067204

§ 371 (c)(1),
(2), (4) Date: Jul. 9, 2010

(87) PCT Pub. No.: WO2009/041444

PCT Pub. Date: Apr. 2, 2009

(65) Prior Publication Data

US 2010/0306937 A1 Dec. 9, 2010

(30) Foreign Application Priority Data

Sep. 25, 2007 (JP) ..... 2007-247732
Sep. 25, 2007 (JP) ..... 2007-247737

(51) Int. Cl.
*A47K 11/10* (2006.01)

(52) U.S. Cl.
USPC ..... 15/104.94; 15/210.1; 15/226

(58) Field of Classification Search
USPC ..... 15/104.93, 104.94, 210.1, 226
See application file for complete search history.

(56) References Cited

U.S. PATENT DOCUMENTS

| | | | | |
|---|---|---|---|---|
| 7,650,663 | B2 * | 1/2010 | Michaels et al. | 15/210.1 |
| 2004/0111817 | A1 * | 6/2004 | Chen et al. | 15/104.94 |
| 2005/0246848 | A1 * | 11/2005 | Morgan et al. | 15/210.1 |
| 2005/0283931 | A1 * | 12/2005 | Endo et al. | 15/104.94 |

FOREIGN PATENT DOCUMENTS

| | | | |
|---|---|---|---|
| JP | 2002-238822 | A | 8/2002 |
| JP | 2004-532078 | A | 10/2004 |
| JP | 2006-307389 | | 11/2006 |
| WO | WO2005/046419 | A1 | 5/2005 |

OTHER PUBLICATIONS

International Search Report for corresponding PCT application No. PCT/JP2008/067204, dated Dec. 22, 2008, 3 pages.
Japanese Office Action and English translation from corresponding Japanese Application No. 2007-247732 dated Feb. 19, 2013 (5 pgs).
Japanese Office Action and English Translation From Corresponding Japanese Application No. 2007-247737 dated Feb. 19, 2013 (6 pgs).

* cited by examiner

*Primary Examiner* — Randall Chin
(74) *Attorney, Agent, or Firm* — Brinks Hofer Gilson & Lione

(57) ABSTRACT

A cleaning tool includes a cleaning unit including a water-disintegrable cleaning substrate which is dispersible in water, and which holds a microcapsule encapsulating a cleaning component.

18 Claims, 7 Drawing Sheets

CLEANING TOOL

RELATED APPLICATION

This application is a 35 U.S.C. §371 national phase filing of International Patent Application No. PCT/JP2008/067204 filed Sep. 24, 2008, to which priority is claimed under 35 U.S.C. §120 and through which priority is claimed under 35 U.S.C. §119 to Japanese Patent Application Nos. 2007-247732, filed Sep. 25, 2007, and 2007-247737, filed Sep. 25, 2007.

TECHNICAL FIELD

The present invention relates to a cleaning tool, and relates to a cleaning tool particularly preferable for used in places where water is used, such as toilets.

BACKGROUND ART

For cleaning toilets and the like, tools capable of removing urine stones, which are precipitated and hardened components of urine, are demanded. Urine stones are those produced through bonding of inorganic components such as calcium phosphate and organic stains such as protein stain, which are originated from urine. Urine stones are stains hard to remove, and cause bad odor.

Conventionally, protein stains including urine stones are physically removed by being entangled with fibers of a sheet or the like using a nonwoven fabric or the like. Alternatively, protein stains are removed by being scrubbed with a non-water-disintegrable brush or the like after a detergent is sprayed to a toilet bowl.

Moreover, toilet brushes are known which are formed of water-soluble materials and partially impregnated with surfactants or the like (for example, refer to Patent Document 1).

However, when a detergent (a chemical) and a non-water-disintegrable brush or the like are prepared to perform cleaning, the detergent has to be sprayed before the cleaning with the brush. After the cleaning, the brush is to be stored, which necessitates washing the brush and finding a storage place after the cleaning, and which also causes concern about sanitation. Moreover, such cleaning presents a safety problem because a strong chemical may be brought into direct contact with the skin of a user, for example, when the detergent is splashed during operation.

In contrast, the cleaning tool described in Patent Document 1 has an advantage that the brush can be disposed of by being flushed with water after completion of toilet cleaning. However, since the water-soluble material forming the brush is directly impregnated with a chemical, the water-soluble material degrades when the chemical is strongly oxidizing. As a result, chemicals which can be impregnated are naturally limited to components which do not degrade the water-soluble material. Hence, a chemical strong enough to remove urine stones cannot be impregnated, and thus a sufficient urine stone removal effect cannot be obtained.

Patent Document 1: Published Japanese Translation of PCT International Application No. 2006-525038

DISCLOSURE OF THE INVENTION

In this connection, the present invention is made in view of the above-described problems, and an object thereof is to provide a cleaning tool which can be used simply, safely, and hygienically, and which has a high washing capability.

A first aspect of the present invention is a cleaning tool including a cleaning unit including a water-disintegrable cleaning substrate which is dispersible in water, and which holds a microcapsule encapsulating a cleaning component.

A second aspect of the present invention is a cleaning tool including a cleaning unit including: a water-disintegrable cleaning substrate which is dispersible in water; and a layer containing a cleaning component.

BEST MODES FOR CARRYING OUT THE INVENTION (First Embodiment)

First, brief description will be made of a characteristic structure of a cleaning tool 1 according to a first embodiment of the present invention with reference to the drawings. Second, further detailed description will be made of the cleaning tool 1 according to the first embodiment of the present invention, including description of constituent materials thereof and the like.

Figure 1:
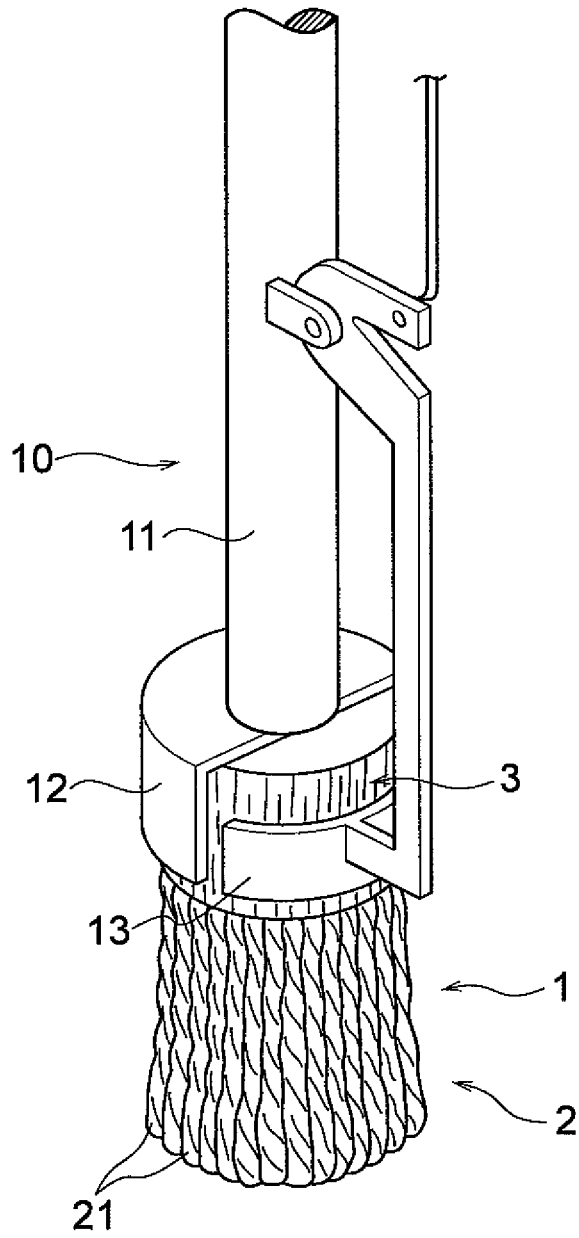
FIG. 1 is a schematic perspective view showing an outline of a cleaning tool according to a first embodiment of the present invention.

FIG. 1 is a view schematically showing an outline of a cleaning tool 1 according to the first embodiment of the present invention. As shown in FIG. 1, the cleaning tool 1 includes a cleaning unit 2, and the cleaning unit 2 includes water-disintegrable cleaning substrates 21 which are dispersible in water.

Figure 2:
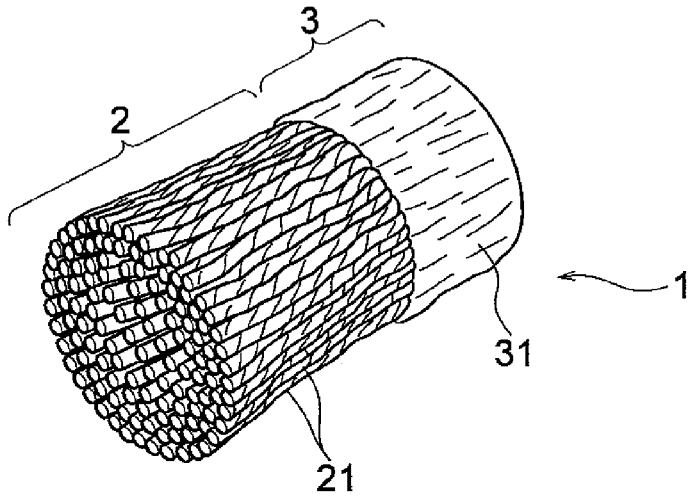
FIG. 2 is a schematic perspective view showing an outline of a part of the cleaning tool according to the first embodiment of the present invention.

FIG. 2 is a view schematically showing an outline of a part extracted from the cleaning tool 1 shown in FIG. 1.

Figure 3:
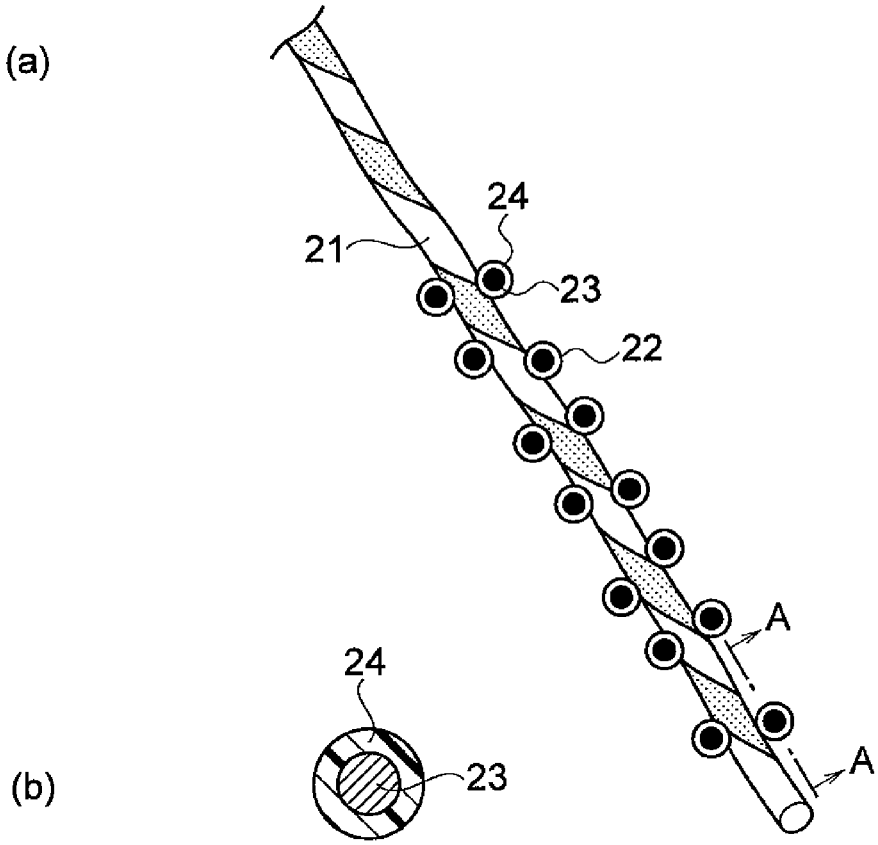
FIG. 3*a* is an enlarged schematic view of a part of the cleaning tool according to the first embodiment of the present invention and FIG. 3*b* is a sectional view of FIG. 3*a* taken along section lines A-A.

FIG. 3(*a*) is an enlarged view schematically showing a part of a cleaning substrate 21 of the cleaning tool 1 shown in FIG.

1 and FIG. 2. As shown in FIG. 3(*a*), the cleaning substrate 21 holds microcapsules 22 on an outer surface thereof, which is brought into contact with a part to be cleaned. Each of the microcapsules 22 includes a core portion 23 and a capsule membrane 24, as is seen from the cross-sectional view shown in FIG. 3(*b*). The core portion 23 contains a cleaning component, and encapsulated with the capsule membrane 24.

Figure 4:
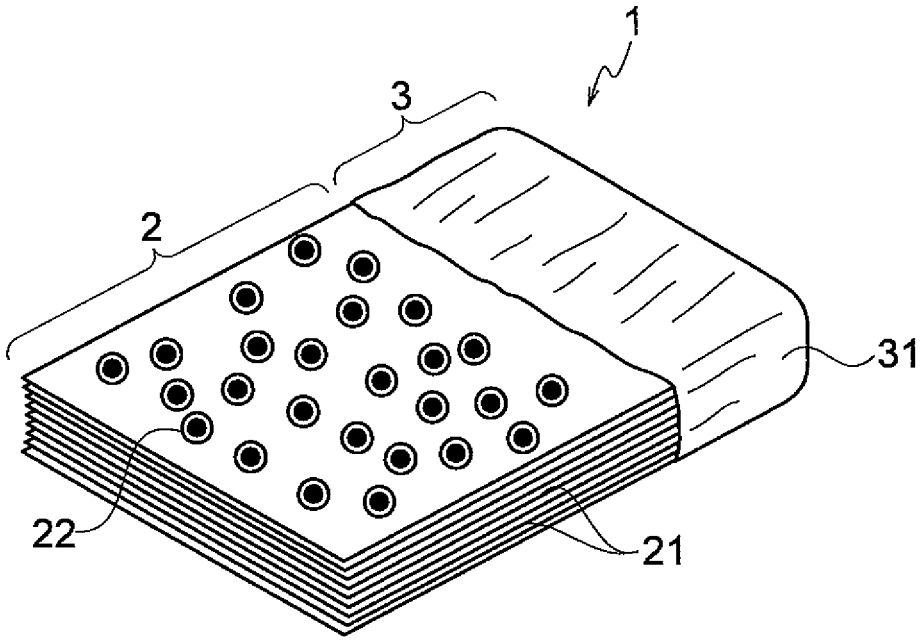
FIG. 4 is an enlarged schematic view showing an outline of a cleaning tool according to the first embodiment of the present invention.
Figure 5:
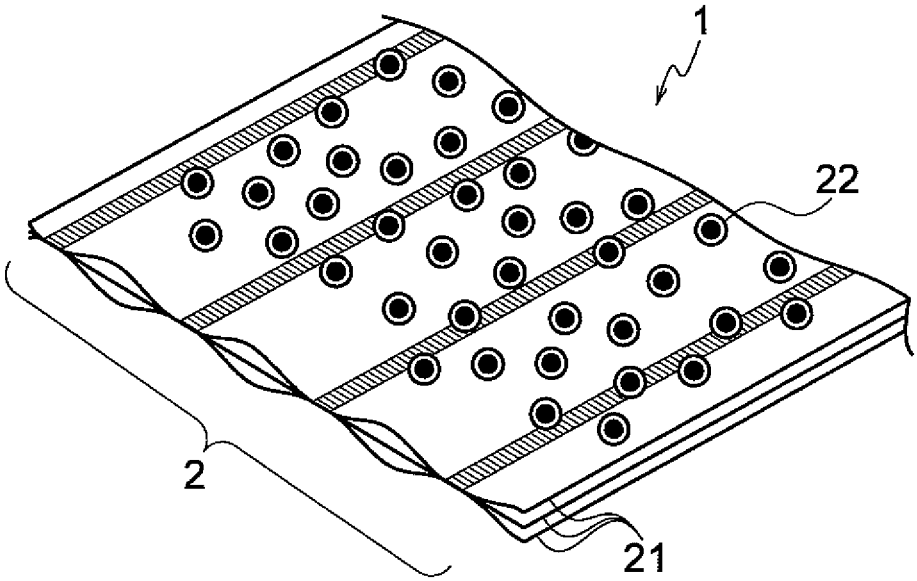
FIG. 5 is an enlarged schematic view showing an outline of a cleaning tool according to the first embodiment of the present invention

FIG. 4 and FIG. 5 are views each schematically showing another aspect of the cleaning tool 1 according to this embodiment. As similar to the above-described case, each of these cleaning tools 1 includes a cleaning unit 2 having cleaning substrates 21, and the cleaning substrates 21 hold the microcapsules 22 encapsulating a cleaning component on an outer surface thereof, which is brought into contact with a part to be cleaned.

As shown in FIG. 1, FIG. 2, and FIG. 4, the cleaning tool 1 may include a bundling portion 3.

Moreover, as shown in FIG. 1, the cleaning tool 1 including the bundling portion 3 may be provided with a holder 10 which holds the bundling portion 3 attachably and detachably.

Figure 6:
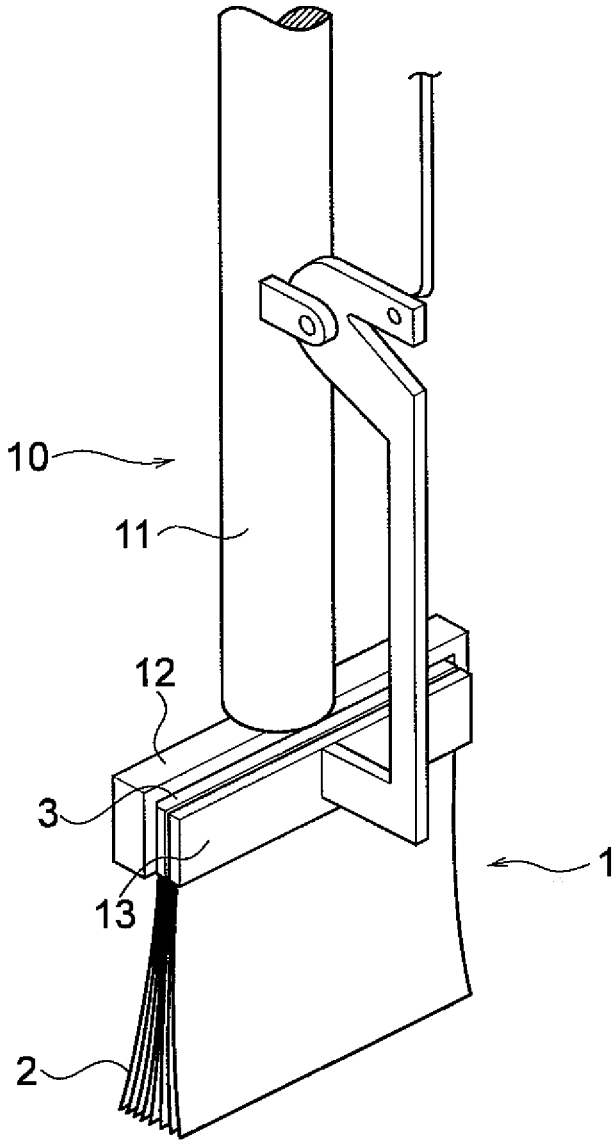
FIG. 6 is a schematic perspective view showing an outline of a cleaning tool according to the first embodiment of the present invention.

FIG. 6 is a view schematically showing also an outline of the cleaning tool 1 according to this embodiment. The cleaning tool 1 is provided with a holder 10 which holds the bundling portion 3 attachably and detachably.

Next, the cleaning tool 1 of the present invention, as well as constituent materials thereof, will be described in further details.

In each of the cleaning tools 1 according to this embodiment, the cleaning unit 2 has multiple water-disintegrable cleaning substrates 21 which are dispersible (also simply referred to as "substrates" in some cases), as shown in, for example, FIG. 1 to FIG. 3.

For the cleaning substrate 21, the term "dispersible in water," i.e. "water-disintegrable" means that the cleaning substrate 21 disintegrates into two or more pieces in water, and loses an original shape. Since the cleaning substrates 21 forming the cleaning unit 2 are water-disintegrable and disintegrated into a lot of small pieces in water in a short period of time, the cleaning unit 2 can be disposed of into a toilet or the like, and can be flushed down without any treatment, after used for cleaning.

More specifically, a "water-disintegrable" substrate herein is one whose disintegration time in water is of 700 seconds or less, when determined in accordance with "JIS P4501 (toilet paper disintegratability test)".

Specifically, into a beaker having a capacity of 300 mL, 300 mL of ion-exchanged water at a water temperature of 20±5° C. is placed, and a test piece was put thereinto (here, when the cleaning substrate is a cord, the length thereof is 100 mm; when the cleaning substrate is a sheet, the size thereof is 100 mm×100 mm; and when the cleaning substrate is a block the size thereof is 30 mm×30 mm×30 mm). When the test piece together with ion-exchanged water is stirred by rotating a stir bar in water at a rotation speed of 600 rpm, time taken until the shape of the test piece is lost, and the test piece is dispersed as individual constituent fibers is measured.

The disintegration time in water of the cleaning substrate is preferably 600 seconds or less, and more preferably 300 seconds or less. Meanwhile, the disintegration time in water of the cleaning substrate is preferably 180 seconds or more, and more preferably 240 seconds or more, so that a cleaning operation can be performed smoothly by avoiding rapid disintegration during the cleaning.

For such a water-disintegrable cleaning substrate, a wide variety of materials known as water-soluble or water-disintegrable materials, such as water-disintegrable papers, water-disintegrable nonwoven fabrics, PVA (polyvinyl alcohol) films, and the like, can be used. Among these, water-disintegrable papers are preferable. Here, the water-soluble material means a material completely dissolves in water, and the water-disintegrable material means a material which can be dispersed in water, while converted into as small pieces.

Examples of kinds of fibers forming these water-soluble or water-disintegrable materials, i.e., kinds of fiber forming the cleaning substrates 21 include wood pulp, regenerated cellulose, hemp, cotton, and the like, and wood pulp is preferable. As long as at least a part of the constituent fibers are any of these water-soluble or water-disintegrable fibers, a water-disintegrable cleaning substrate 21 can be formed. However, all of the constituent fibers are preferably any of these water-disintegrable or water-soluble fibers.

Among these, biodegradable fibers are preferable, from the viewpoint of reduction of environmental load. Examples of the biodegradable fibers include wood pulp, regenerated cellulose, hemp, cotton, and the like.

The fiber length of these fibers is preferably in a range of 20 mm or less, and further preferably in a range of 10 mm or less, from the viewpoint of water-disintegrability Bonding (adhesion) between these fibers forming the cleaning substrate can be achieved by hydrogen bonding force hydrogen bonding force, adhesive force of a water-soluble binder, or physical entanglement of fibers by use of water jet or the like. Examples of the water-soluble binder include polyvinyl alcohol, polyacrylic acid, carboxymethylcellulose, sodium alginate, and the like.

Any shape or form can be employed for the cleaning substrate 21. The cleaning substrate 21 may be a cord as shown in, for example, FIG. 1 to FIG. 3, a sheet-like shaped as shown in FIG. 4 to FIG. 6, or a block-shaped, for example, cylindrically shaped, which is not shown in the drawings.

Meanwhile, the cleaning unit 2 may be formed of a single cleaning substrate 21, or multiple cleaning substrates 21.

When each of the cleaning substrates 21 is a cord, the multiple cord-shaped substrates can be bundled like a brush for use. FIG. 1 and FIG. 2 show one example thereof, in which cord-shaped cleaning substrates 21 are bundled like a brush to form the cleaning unit 2.

When each of the cleaning substrates 21 is sheet-shaped, the multiple sheet-shaped substrates may be stacked, and may be partially adhered to each other, if necessary as shown in FIG. 4 and FIG. 5; alternatively, one or multiple substrates can be rolled up or folded up for use.

Moreover, a combination of substrates with different shapes or forms may be employed. An example thereof is a structure in which multiple cords are arranged around a single or multiple sheet-shaped substrates or block-shaped substrates.

Each of the cleaning substrates 21 may further have a substructure.

Figure 7:
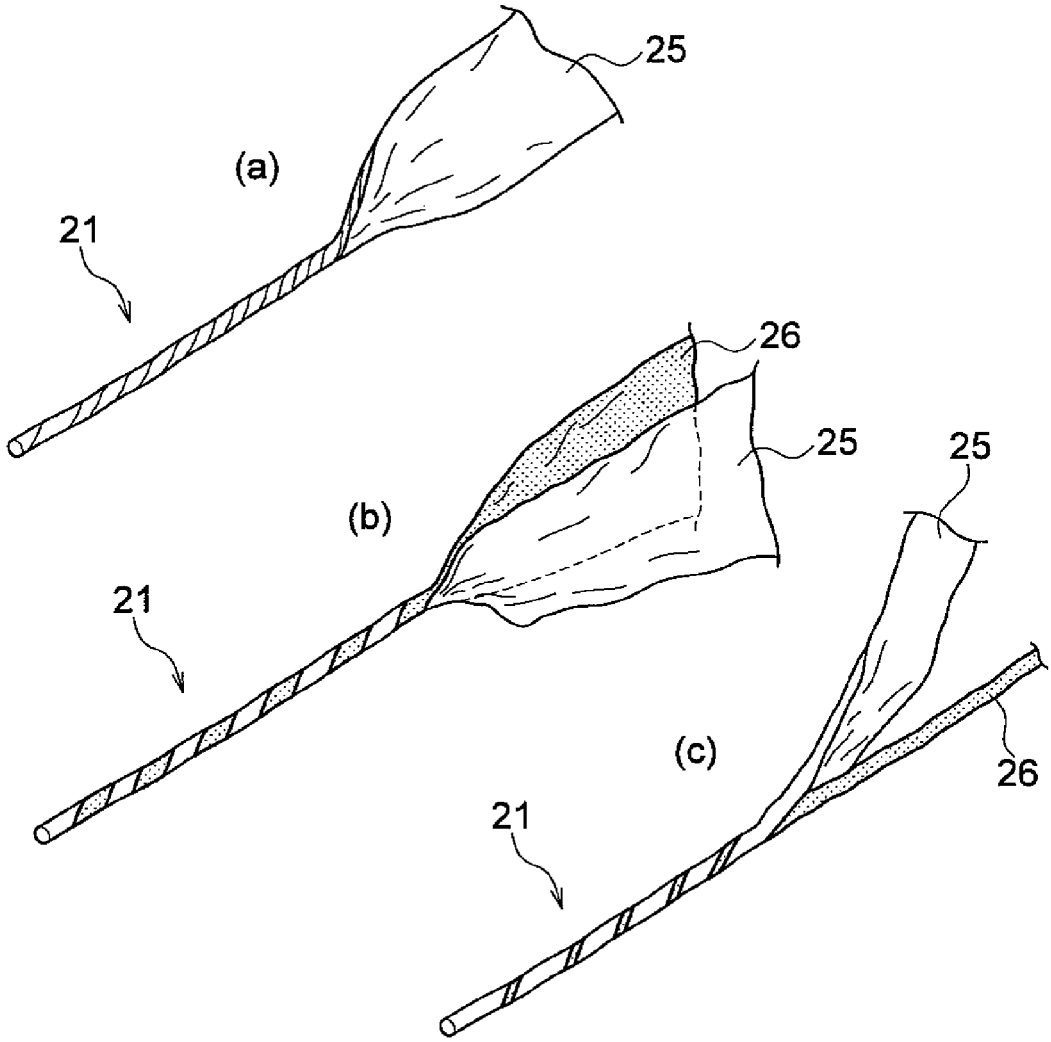
FIGS. 7*a*-7*c* are perspective views for schematically illustrating a part of a production process of a cleaning tool according to the first embodiment of the present invention.

Specifically, when the substrate is cord-shaped, usable are one obtained by twisting one water-disintegrable sheet 25 into a cord as shown in FIG. 7(*a*), and one obtained by stacking a water-disintegrable sheet 25 and a water-disintegrable paper 26 as shown in FIG. 7(*b*), and forming a twisted cord therefrom. Furthermore, as shown in FIG. 7(*c*), one obtained by forming a core of a water-disintegrable paper 26, and winding a water-disintegrable sheet 25 therearound to be formed into a cord may be used. When a cord formed by twists is disposed of into water after use and is brought into contact with a large amount of water, the twists of the cord are loosen, whereby the cord can be disintegrated in a relatively short period of time in water.

When the substrate is sheet-shaped, the substrate sheet itself may be a stack obtained by stacking thinner multiple sheets and partially adhering the sheets to each other. Also in this case, it is expected that the substrate is disintegrated in water rapidly.

As described above, any shape and structure can be employed for the substrate; however, the substrate preferably has a physical strength suitable for cleaning and such a favorable water-disintegrability as to be disposable together with water without any treatment after use.

In one preferable embodiment, the cleaning tool 1 includes a bundling portion 3, as shown in, for example, FIG. 1, FIG. 2. The bundling portion 3 is provided in one end of the cleaning substrate 21 of the cleaning unit 2, and holds the cleaning substrate 21. The cleaning tool 1 provided with the bundling portion 3 can be mounted on the holder 10 to be described later attachably and detachably by use of the bundling portion 3.

When the cleaning unit 2 has multiple cleaning substrates 21, the bundling portion 3 bundles these multiple cleaning substrates 21 to each other and holds these multiple cleaning substrates 21 integrally. For example, when each of the cleaning substrates 21 is a cord, the bundling portion 3 is formed by bundling one ends of these multiple cords (cleaning substrates) 21, as shown in FIG. 1 and FIG. 2. The multiple cords are fixed to each other in the bundling portion 3, but exist independently of each other in the cleaning unit 2.

In a structure shown FIG. 2, end faces of the cords 21 exist in the cleaning unit 2. Although not shown, a structure may be employed in which the cords 21 are bent, bent portions exist at a tip portion (an end portion on a side which is not a side of the bundling portion) of the cleaning unit 2, and end portions of both sides of the cords are fixed by being bundled with a bundling portion.

Also when the cleaning unit 2 has a single cleaning substrate 21, the bundling portion 3 is provided in one end of the substrate, and holds the cleaning substrate 21.

The bundling portion 3 is also preferably formed of a water-disintegrable material dispersible in water, as similar to the above-described cleaning unit 2. When the bundling portion 3 is water-soluble or water-disintegrable, the cleaning unit 2 together with the bundling portion 3 can be disposed of in water after use, and flushed down without any treatment. For example, the bundling portion can be formed of a material which is the same as those for the above-described cleaning substrates 21.

More specifically, this bundling portion 3 can be formed by winding a water-disintegrable holding member 31 around cleaning substrates 21 as shown in FIG. 2.

More specifically, a preferable example is a structure in which about 5 to 50 cords being cut into a length of 30 to 100 mm and having an identical length are bundled; end faces thereof are adhered to each other with a water-soluble adhesive (a water-soluble binder); and a holding member 31 is wound around an outer surface of the bundle, and adhered thereto with a water-soluble adhesive. Specifically, the cords 21 are adhered and fixed to each other in the bundling portion 3, whereas the individual cords 21 are independent of each other in the cleaning unit 2.

Although the bundling portion 3 shown in FIG. 2 has a cylindrical shape, the bundling portion 3 may have any shape. For example, the bundling portion may have a flat shape as shown in FIG. 4.

In an example shown in FIG. 4, one ends of the multiple sheet-shaped substrates 21 are held by the bundling portion 3. This bundling portion 3 can also be formed by winding a water-disintegrable holding member 31 around the cleaning substrates 21. The sheet-shaped substrates 21 may be adhered to each other with a water-soluble adhesive in the bundling portion 3.

The cleaning tool 1 is preferably provided with a holder 10 on and by which the above-described bundling portion 3 is mounted and held attachably and detachably, as shown in FIG. 1 and FIG. 6. With the bundling portion 3 mounted on and held by the holder, the cleaning unit 2 is fixed to the holder. Thereby, cleaning operation such as wiping can be performed with the cleaning unit 2, with a rod 11 of the holder 10 held by the hand.

This allows cleaning of a part to be cleaned, while direct contact of the hand with the cleaning unit 2 is avoided. When the rod 11 of the holder is moderately long, an inside portion of a toilet bowl, for example, can be cleaned, with the face being kept away from the part to be cleaned.

This holder 10 preferably has a bundling portion-mounting structure which allows the cleaning unit to be disposed of after cleaning, while contact of the hand with the bundling portion 3 or the cleaning unit 2 is avoided. This allows the cleaning unit 2 to be detached from the holder without contact of the hand therewith after cleaning and to be disposed of in a water flush toilet or the like, easily, and is thus hygienic.

FIG. 1 shows the cleaning tool 1 in which the bundling portion 3 holding the cleaning unit 2 shown in FIG. 2 and formed of the cords 21 is mounted attachably and detachably on the holder 10. The bundling portion 3 is held between a containing portion 12 and a pressing portion 13 of the holder 10, by being pressured by the pressing portion 13. When the pressing portion 13 of the holder 10 is detached from the containing portion 12, the pressing force by the pressing portion 13 is released, whereby the cleaning unit 2 is separated.

FIG. 6 is one suitable for a cleaning tool 1 made of the sheet-shaped substrates 21 shown in FIG. 4, and shows the cleaning tool 1 in which a bundling portion 3 which holds the cleaning unit 2 are attachably and detachably mounted on a holder 10 between a containing portion 12 and a pressing portion 13.

Meanwhile, FIG. 5 shows one example of a cleaning tool 1 in which the cleaning unit 2 has no bundling portion. In this case, scrubbing by the hand with this cleaning tool 1 allows, for example, finely structured portions and uneven parts, such as a portion around a toilet bowl and a floor, to be cleaned easily, and the cleaning tool 1 can be similarly disposed of in water without any treatment after use.

Next, the microcapsules 22 held by the above-described cleaning substrate 21 will be described.

Specifically, the cleaning substrate 21 holds the microcapsules 22 in which a capsule membrane 24 encapsulates a cleaning component 23, as shown in FIG. 3 to FIG. 5.

This cleaning component may be selected as appropriate in accordance with an application of the cleaning tool 1, that is, stain on a part to be cleaned, and is not particularly limited. As the cleaning component, a wide variety of substances known as cleaning components for cleaning can be used.

In a preferable example, it is preferable to use a component effective to remove urine stones attached to a toilet bowl and the like as the cleaning component, when the cleaning tool 1 is used for a toilet.

Urine stones are precipitated and hardened components of urine, and are composite stains containing inorganic substances such as calcium phosphate, and organic substances such as protein which are originated from urine.

Acidic substances are effective to remove calcium-containing compounds. This is because acids decompose calcium salts.

Surfactants are effective to remove stain containing protein. In addition to an effect of decomposing and removing stain, surfactants have an effect of preventing the cleaning component from flowing down and hence keeping the cleaning component at a stained portion by foaming.

Accordingly, when the cleaning tool 1 is used for a toilet, it is preferable to contain an acid and a surfactant, and it is further preferable to contain an organic acid and a cationic surfactant as will be described below, as the cleaning component encapsulated in the microcapsules 22.

As an acid for decomposing urine stones, an inorganic acid or an organic acid can be used; however, an organic acid is preferable from the viewpoints of safety to human body and an influence on microbes in septic tanks.

As the organic acid, usable are, for example, glycolic acid, diglycolic acid, gluconic acid, oxalic acid, malic acid, citric acid, lactic acid, tartaric acid, acetic acid, hydroxyethane diphosphonic acid, malonic acid, succinic acid, adipic acid, fumaric acid, benzoic acid, isophthalic acid, ortho-phthalic acid, terephthalic acid, salicylic acid, maleic acid, methylene succinic acid, isocyanuric acid, p-toluenesulfonic acid, and the like. These organic acids may be used alone, or may be used as a mixture of two or more kinds.

Among these, glycolic acid, citric acid, gluconic acid and malic acid are preferable, from the viewpoints of safety and cost.

As the inorganic acid, usable are hydrochloric acid, sulfuric acid, phosphoric acid, tripolyphosphoric acid, sulfamic acid, sodium hydrogensulfate, potassium hydrogensulfate, ammonium hydrogensulfate, ammonium chloride, ammonium sulfate, and the like.

Those inorganic acids also may be used alone, or may be used as a mixture of two or more kinds.

Surfactants such as higher fatty acid salts, various sulfate ester salts, and various sulfonate salts have been known. These various surfactants can be used. For example, alkylamine oxides, polyoxyethylene alkyl ethers, sodium alkyl ether sulfate esters, and the like are preferably used, from the viewpoints of penetrating capability, and foamability.

Among these surfactants, cationic surfactants are preferable for removing stain components containing protein. This is because protein is anionic, and cationic surfactants ionically increase reactivity. These surfactants may be used alone, or as any combination of multiple kinds.

Cationic surfactants are surfactants which become cationically charged under acidic conditions. Examples thereof include those generally referred to as cationic surfactants and other surfactants which become cationically charged under acidic conditions.

Examples include quaternary ammonium salts such as alkyltrimethylammonium salts, dialkyldimethylammonium salts, alkylammonium salts, benzalkonium salts, and benzethonium salts; pyridinium salts; imidazolium salts, and the like. Other examples are amphoteric surfactants such as alkyl carboxybetaines, alkyl sulfobetaines, alkyl amino carboxylic acid salts, alkyl imidazolium betaine; nitrogen-containing nonionic surfactants such as alkylaminoxides, and alkylamide amine oxides.

Among those, amphoteric surfactants are preferable from the viewpoint of environmental protection.

The cleaning component (a composition for cleaning) can contain various additives such as thickeners, pH adjusters, chelating agents, preservatives, antioxidants, antibacterial agents, fragrances, and colorants, or various solvents (diluents) such as water, oils, and alcohols, as long as effects of the present invention are not impaired.

This cleaning component may be a powder, but is preferably a liquid in a form of containing a diluent capable of dissolving contained and blended components stably, from the viewpoint of penetrating capability into stain.

In a cleaning component (a composition for cleaning) which is prepared as a liquid by containing the diluent, the concentration of the acid is preferably in a range from 0.1 to 3.0% by weight, and further preferably in a range from 0.5 to 2.0% by weight, from the viewpoint of removal of calcium-containing compounds.

The concentration of the surfactant in the cleaning component is preferably in a range from 1.0 to 10.0% by weight, and further preferably in a range from 3.0 to 8.0% by weight, from the viewpoints of penetrating capability, and foamability.

Moreover, the pH of the cleaning component is preferably in a pH range from 1.0 to 6.0, and further preferably in a pH range from 1.0 to 4.0, from the viewpoint of removal of calcium-containing compounds.

The organic acid is preferably one capable of adjusting the pH of the cleaning component to a range from 1.0 to 6.0.

The above-described cleaning component is encapsulated in the capsule membrane 24 of the microcapsule 22 as the core portion (a core substance) 23.

As a membrane material forming the capsule membrane 24, preferably used is a material capable of stably encapsulating the cleaning component, which is the core substance. Specifically, when the cleaning component contains, for example, an acid, it is important to select a substance which is stable in the contained acid, or which is not decomposable by the acid.

The membrane material is not particularly limited, and specific examples thereof include organic polymeric substances such as gelatin, gelatin-gum Arabic, gum Arabic, gellan gum, chitosan, acrylic resin, urethane resin, melamine resin, urea-formalin resin, nylon, polyether, alginic acid, alginic acid salts, polyvinyl alcohol, polystyrene, paraffin, cellulose, carboxymethylcellulose, methylcellulose; and inorganic substances such as titanium dioxide, calcium carbonate, carbon black, silica, alkaline earth metals, silicic acid salts, iron oxide, cobalt carbonate, and zinc oxide.

Particularly, the membrane material is preferably water-soluble or water-disintegrable. This is because when the membrane material is water-soluble or water-disintegrable, the membrane wetted with water at the time of use is ruptured, and the cleaning component is easily released. Preferable examples of the water-soluble or water-disintegrable membrane material include polymers which are mainly based on water-soluble polymers having amino groups or carboxyl groups at their terminals and which are represented by gelatin, chitosan, agar, starch, glue, and the like. Among these, gelatin or the like can be used preferably.

In this case, a degree of water-solubility or water-disintegrability of the membrane material is preferably higher than a degree of water-solubility or water-disintegrability of the substrate. Specifically, it is preferable that, during cleaning, the membrane material be easily ruptured, but the substrate do not undergo water-disintegration or the like, and keep the shape thereof until disposal. Specifically, the disintegration time in water of the membrane material measured in accordance with the above-described JIS P4501 is preferably 30 seconds or less, and more preferably 10 seconds or less.

However, the membrane material is not necessarily water-soluble or water-disintegrable. In such a case, the physical strength of the membrane material is adjusted so that the capsule membrane 24 can be ruptured by abrasion against a part to be cleaned, and the cleaning component can be released at the time of use. This provides a high cleaning effect.

Furthermore, the membrane material is preferably a biodegradable material such as polylactic acid, or an alginate salt (calcium alginate or the like), in consideration of environmental protection and the like.

The thickness of the capsule membrane 24 is preferably in a range of 1 to 20 μm, and more preferably in a range of 5 to 15 μm. The membrane thickness can be determined with shape determination software which comes with an electron microscope.

The size of the microcapsules 22 is preferably in a range from 100 to 1000 μm, and further preferably in a range from 100 to 500 μm, in terms of average particle diameter. The average particle diameter can be measured with a profile projector or a particle size distribution analyzer.

As a method for producing the microcapsules 22, various commonly known methods can be employed. The method may be any one of an interfacial reaction method in which a coating film is formed by an interfacial reaction, and an interfacial deposition method in which a coating film is formed by use of a mechanical (physical) or physicochemical technique.

Examples of interfacial reaction methods include an interfacial polymerization method, an in situ method, an in-liquid hardening method, an interfacial reaction method (a method utilizing a deposit-formation reaction of inorganic substances), and the like. Any one of those methods can be employed.

Examples of interfacial deposition methods include a phase separation method, a coacervation method, an in-liquid drying method, a melt-dispersion-cooling method, a spray drying method, a Wurster method, a gas-phase suspension coating method, a powder-bed method, a powder-mixing method, and the like. Any one of those methods can be employed.

The following shows an example of a method of producing the microcapsules 22 by using a water-soluble polymer as the membrane material.

Aqueous solutions are prepared from the water-soluble polymer and the cleaning component, respectively, and added to an organic solvent to which a nonionic surfactant is added, followed by occasional stirring. Thus, a W/O emulsion is prepared. The nonionic surfactant is preferably nonionic and highly lipophilic. Examples thereof include sorbitan tristearate, sorbitan sesquioleate, sorbitan monostearate, sorbitan monopalmitate, sorbitan monooleate, glycerine monostearate, glycerine monooleate, glycerose monostearate, glycerose monooleate, and the like. Examples of the organic solvent include cyclohexane, carbon tetrachloride, chloroform, dichloromethane, xylene, nitrobenzene, and the like. For example, a combination of sorbitan trioleate (span 85) and cyclohexane is preferable.

To this W/O emulsion, a reaction agent is added. The reaction agent is a reagent added for causing an interfacial polymerization with amino groups or carboxyl groups at the terminals of the water-soluble polymer. As the reaction agent, an acid anhydride, an acid halide, or the like is used. Examples of the acid anhydride include maleic anhydride, o-phthalic anhydride, succinic anhydride, and the like. Examples of the acid halide include terephthaloyl dichloride, adiponitrile dichloride, γ-benzoyl pimelic acid dichloride, γ-acetyl pimelic acid dichloride, and the like. Among these, terephthaloyl dichloride is preferable from the viewpoint of reactivity.

Preferably, the reaction agent is added as an organic solvent solution. As the organic solvent, usable are water-immiscible ones such as dichloromethane, chloroform, chloroethane, dichloroethane, trichloroethane, benzene, cyclohexane, heptane, carbon tetrachloride, dichloromethane, xylene, nitrobenzene, n-hexane, toluene, ethyl ether, and ethyl acetate. A combination of two or more of these organic solvents may also be used. Among these, cyclohexane is preferable from the viewpoint of partition coefficient.

The capsule membrane 24 formed from the water-soluble polymer and the reaction agent is dehydrated by use of an alcohol, and hardened. Examples of the alcohol include ethanol and isopropanol. Isopropanol is preferable from the viewpoint of dehydration performance.

As another method, also preferable is a method in which the capsule membrane 24 is produced and then impregnated with a solution of the cleaning component for encapsulating the cleaning component, which is the core substance.

A process of holding the microcapsules 22 on the cleaning substrate 21 is preferably performed at a stage after the shaping of the substrate and the completion of formation of the cleaning unit 2, in order to prevent the breakage of the microcapsules 22 during the process. For example, for the cleaning tool 1 shown in FIG. 5, it is preferable that three cleaning substrates be adhered to each other to complete the formation of the cleaning unit, and then the capsules be held lastly. However, unless there are possibilities that the microcapsules 22 may be broken, the formation of the cleaning unit 2 may be completed after the microcapsules 22 are held on the cleaning substrate 21.

Examples of a method for holding the microcapsules 22 on the cleaning substrate 21 include spray coating, impregnation coating, and the like. Preferably employed is a method using heat or a method using a binder.

In the heat application method, hydrogen bonding is formed between a membrane material of gelatin membranes or the like and the substrate, whereby the microcapsules 22 can be fixed to the cleaning substrate 21. Specifically, for example, the microcapsules 22 are dispersed in isopropanol, spray coated onto the cleaning substrate 21, and the isopropanol is dried in an atmosphere of 60° C. to 80° C.

In the method using a binder, a water-soluble polymer, such as polyvinyl alcohol (PVA) or carboxymethylcellulose (CMC), as the binder, is coated onto a part of the substrate in advance. Thereby, the microcapsules 22 are selectively held on the cleaning substrate 21. Specifically, first, a binder is spray coated onto the cleaning substrate 21, then the microcapsules 22 from which isopropanol is removed by filtration through a mesh capable of filtration of 50 μm or less are scattered, and the binder is dried in an atmosphere of 100° C. to 120° C., for example.

The amount of the microcapsules 22 used (held) is preferably 0.5% by weight or more, and further preferably in a range from 1 to 10% by weight, relative to the cleaning substrate 21.

The microcapsules 22 are preferably distributed or arranged on the cleaning substrate 21 in a portion to be brought into contact with a part to be cleaned. For example, it is further preferable that most of the microcapsules 22 are distributed in a front end portion of the cleaning substrate 21 as shown in FIG. 3.

As described above, the cleaning component is easily placed locally in any portion, whereby efficient cleaning can be performed. As a result, a fewer amount of a cleaning component is used than that used in a case where a liquid detergent is sprayed directly and used, whereby an effect of reducing load on wastewater environment can also be expected.

Next, a specific method of using the cleaning tool 1 will be described, with a case where the cleaning tool 1 is a cleaning tool for toilet taken as an example.

While the bundling portion 3 of the cleaning tool 1 shown in FIG. 2 or FIG. 4 is held between the containing portion 12 and the pressing portion 13 of the holder 10 shown in FIG. 1 or FIG. 6, cleaning is performed by scrubbing the inside of a toilet bowl of a water flush toilet with the cleaning unit 2. At this time, the capsule membrane 24 of the microcapsules 22 held in the cleaning unit is mechanically broken, and hence the cleaning component is released. Thereby, stain can be effectively removed. Meanwhile, suppose a case where the membrane material of the microcapsules 22 is water-soluble or water-disintegrable, and wiping is performed with the cleaning unit 2 wetted with wash water in a water flush toilet. In such a case, the capsule membranes 24 is wetted and broken, and hence the cleaning component is released. Thereby, stain can be effectively removed.

After cleaning, when the pressing portion 13 of the holder 10 is detached from the containing portion 12, the cleaning unit 2 together with the bundling portion 3 falls into the water flush toilet, and can be flushed down with wash water without any treatment. The fixing force of the bundling portion 3 is released in water, and the cleaning unit 2 is dispersed as individual cleaning substrates 21. For this reason, the cleaning unit 2 flows through piping without clogging. Then, the individual cleaning substrates 21 are disintegrated in the piping or a septic tank, to form separated fibers.

The cleaning tool 1 of the present invention can widely be applied to cleaning tools 1 provided with a water-disintegrable cleaning unit 2.

For example, the cleaning tool 1 of the present invention can be applied to cleaning tools described in Japanese Patent Application Publication No. 2006-314615, Japanese Patent Application Publication No. 2006-314617, Japanese Patent Application Publication No. 2006-314621, and Japanese Patent Application Publication No. 2006-314624.

The cleaning tools described in these documents are water-disintegrable cleaning tools using a fiber entangled nonwoven fabric, a compressed-fiber structure, a wet shrinkable resin, or the like. These cleaning tools are high in strength at the time of scrubbing a toilet bowl or the like, excellent in rigidity, and capable of effectively removing stain. Accordingly, it is possible to provide cleaning tools having a further excellent cleaning effect by causing these cleaning tools to hold the microcapsules in accordance with a configuration of the present invention.

(Second Embodiment)

Hereinafter, a cleaning tool 1 according to a second embodiment of the present invention will be described with reference to FIG. 8 to FIG. 11, while different points from the above-described cleaning tool 1 according to the first embodiment are focused.

The cleaning tool 1 according to this embodiment also includes a cleaning unit 2 as shown in FIG. 1. The cleaning unit 2 has water-disintegrable cleaning substrates 21 which are dispersible in water.

Figure 8:
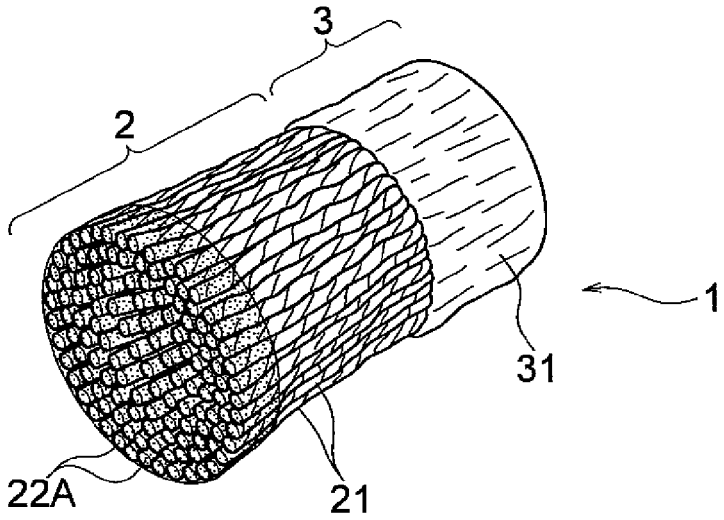
FIG. 8 is a schematic perspective view showing an outline of a part of a cleaning tool according to a second embodiment of the present invention.

FIG. 8 is a view schematically showing an outline of a part of the cleaning tool 1 according to this embodiment. As shown in FIG. 8, a layer 22A containing a cleaning component is formed in a part of a surface of each of the cleaning substrates 21.

Figure 9:
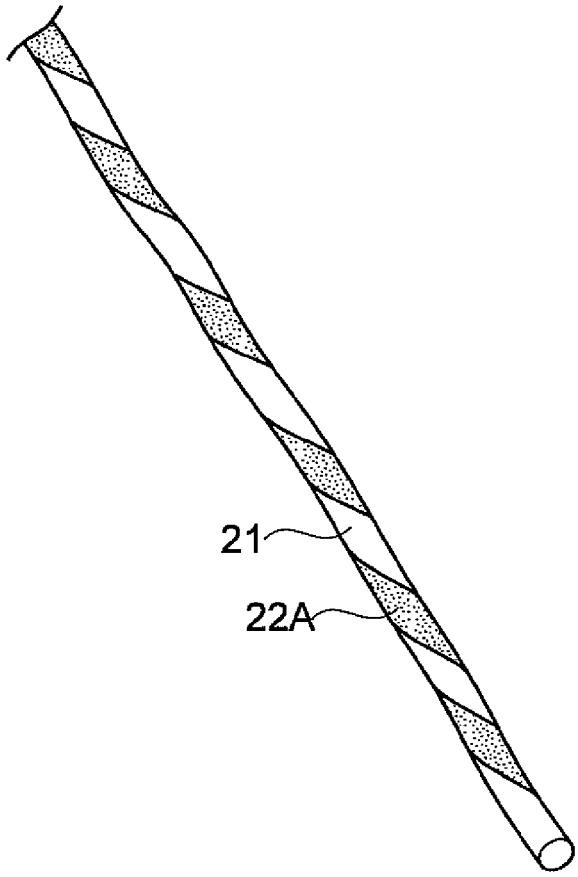
FIG. 9 is an enlarged schematic view showing a part of the cleaning tool according to the second embodiment of the present invention.
Figure 10:
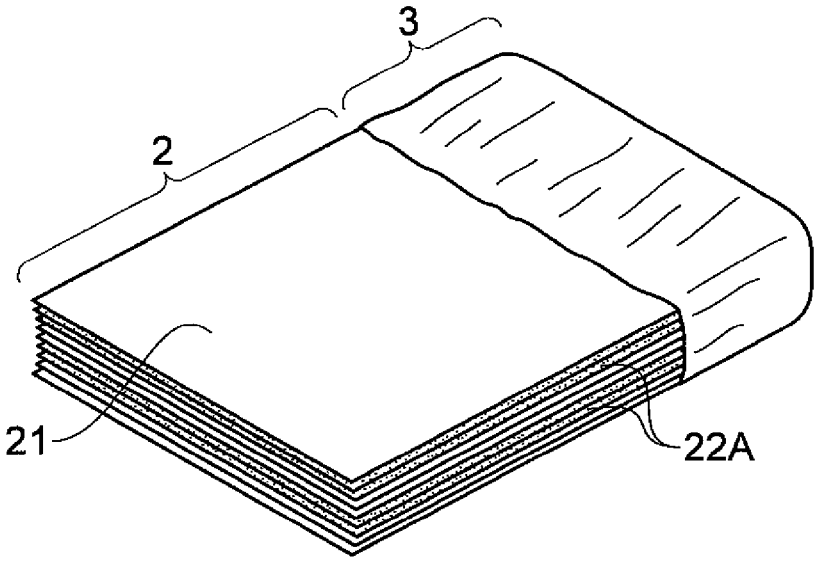
FIG. 10 is an enlarged schematic view showing an outline of a cleaning tool according to the second embodiment of the present invention.
Figure 11:
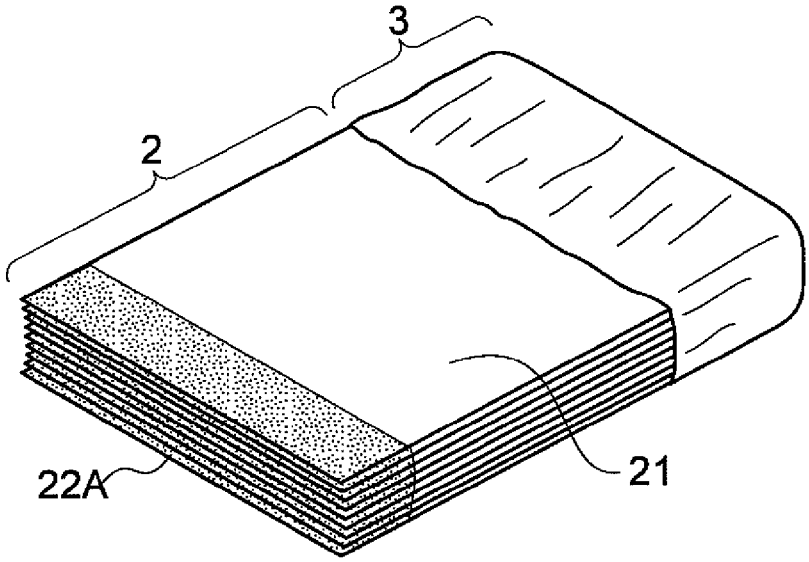
FIG. 11 is an enlarged schematic view showing an outline of a cleaning tool according to the second embodiment of the present invention.

FIG. 9 schematically shows an enlargement of a part of the cleaning substrate 21 of the cleaning tool shown in FIG. 1. FIG. 10 and FIG. 11 are outline views schematically showing different forms, respectively, of the cleaning tool 1 according to this embodiment. FIG. 10 shows a cleaning unit 2 having cleaning substrates 21 and layers 22A containing a cleaning component.

As described above, each of the layers 22A containing a cleaning component may be an independent film (FIG. 10), or a layer formed in at least a part of a surface of a cleaning substrate 21 (FIG. 8, FIG. 9, or FIG. 11).

Next, description will be made of the above-described layer 22A (also referred to as a film) which contains a cleaning component and which is formed on the surface of the cleaning substrate 21.

The cleaning unit 2 has cleaning substrates 21 including the layers 22A containing a cleaning component in at least part of its surface to be brought into contact with a part to be cleaned as shown in FIG. 8 and FIG. 11, or includes independent and separated layers (films) 22A containing a cleaning component as shown in FIG. 10. In the latter case, an arrangement order of the layers (films) 22 containing a cleaning component and the cleaning substrates 21 is not particularly limited, and may be alternating or random. In addition, the layer 22A containing a cleaning component may be formed in a part of a cleaning substrate 21 in a form of an integrated combination of an independent film 22 and the cleaning substrate 21 (FIG. 9).

The cleaning component may be selected as appropriate in accordance with an application of the cleaning tool, that is, stain on a part to be cleaned, and is not particularly limited. As the cleaning component, a wide variety of substances known as cleaning components for cleaning can be used. As such a cleaning component, usable is any of cleaning components similar to those in the case of the above-described cleaning tool 1 according to the first embodiment.

The above-described cleaning component is contained in the layer (film) 22A. The cleaning component may be contained in the layer 22A in any state, but is preferably uniformly mixed and dispersed in the layer.

The concentration of the acid in the layer 22A containing the cleaning component is preferably in a range from 1.0 to 25.0% by weight, and further preferably in a range from 5.0 to 15.0% by weight, from the viewpoint of removal of calcium-containing compounds.

The concentration of the surfactant in the layer 22A containing the cleaning component is preferably in a range from 25.0 to 95.0% by weight, and further preferably in a range from 50.0 to 90.0% by weight, from the viewpoint of penetrating capability, and foamability.

As a material (a layer-forming material) for forming the layer 22A, preferably used is one capable of containing the cleaning component stably. Specifically, when the cleaning component contains, for example, an acid, it is important to select a substance which is stable in the contained acid, or which is not decomposable by the acid.

The concentration of the layer-forming material in the layer 22A is preferably in a range from 4.0 to 74.0% by weight, and further preferably in a range from 5.0 to 45.0% by weight.

The layer-forming material is not particularly limited, and specific examples thereof include organic polymeric substances such as chitosan, gelatin, gellan gum, gum Arabic, acrylic resin, urethane resin, melamine resin, urea-formalin resin, nylon, polyether, sodium alginate, polyvinyl alcohol, polystyrene, paraffin, carboxymethylcellulose, and methylcellulose.

Particularly, the layer-forming material is preferably water-soluble or water-disintegrable. This is because when the layer-forming material is water-soluble or water-disintegrable, the layer wetted with water at the time of use is broken, and the cleaning component is easily released. As the water-soluble or water-disintegrable layer-forming material, a bio-degradable material is preferable, and examples thereof include chitosan, gelatin, gellan gum, sodium alginate, agar, starch, carboxymethylcellulose, glue, and the like.

Among these, chitosan or the like can be used preferably.

In this case, a degree of water-solubility or water-disintegrability of the layer-forming material is preferably higher than a degree of water-solubility or water-disintegrability of the substrate. Specifically, it is preferable that, during cleaning, the layer 22A be easily broken, but the cleaning substrate 21 do not undergo water-disintegration or the like, and keep the shape thereof until disposal. Specifically, a disintegration time in water of the layer-forming material measured in accordance with the above-described JIS P4501 is preferably 30 seconds or less, and more preferably 10 seconds or less.

However, the layer-forming material is not necessarily water-soluble or water-disintegrable. In such a case, the physical strength of the layer-forming material is adjusted so that the film can be broken by abrasion against a part to be cleaned, and the cleaning component can be released at the time of use. This provides a high cleaning effect. Furthermore, the layer-forming material is preferably a bio-degradable material such as polylactic acid, an alginate salt (calcium alginate or the like), in consideration of environmental protection and the like.

When the film is independent, the thickness (after drying) of the layer 22A is preferably in a range from 10 μm to 200 μm, and further preferably in a range from 50 μm to 150 μm. When the film is coated onto a water-disintegrable substrate, the thickness is preferably in a range from 0.1 μm to 100 μm, and further preferably in a range from 1 μm to 50 μm. The thickness of the layer 22A can be measured by a sheet thickness meter.

As a method for forming the layer 22A, various commonly known methods can be employed. For example, a solution (a layer-forming solution) containing the layer-forming material and the cleaning component (and, if necessary, other optional components) is prepared, coated onto the cleaning substrate 21, and dried. Thus, the layer 22A containing the cleaning component can easily be formed on a surface of the cleaning substrate 21. Similarly, any method can be used as a coating method onto the cleaning substrate 21. A spray method or a dipping method may be used. At this time, the solution is preferably an aqueous solution, or an emulsion solution, or the like. Also at this time, it is preferable to select a solvent capable of completely dissolving the cleaning component and the polymer compound which is the layer-forming material, and to adjust concentrations of the solutes.

The concentration of the acid in the layer-forming solution is adjusted so as to be preferably in a range from 0.1 to 3.0% by weight, and further preferably in a range from 0.5 to 2.0% by weight. The concentration of the surfactant in the layer-forming solution is adjusted so as to be preferably in a range from 1.0 to 10.0% by weight, and further preferably in a range from 3.0 to 8.0% by weight.

For example, for the cleaning tools 1 shown in FIG. 8 and FIG. 11, only a front end portion of the cleaning unit 2 (the cleaning substrates 21) is immersed in the layer-forming solution, and dried for film formation. Thereby, the layers 22A can be produced preferably.

A film 22A (the layer containing the cleaning component) may be separately formed, and then the film 22A and a cleaning substrate 21 may be combined. The cleaning tool 1 shown in FIG. 10 is preferably produced by this method. In this example, the cleaning substrates 21 are arranged outside, from the viewpoint of removing stain by mechanical scrubbing at the time of cleaning. When the film 22A is water-soluble, the cleaning component dissolves and is released from the inside during this cleaning operation. Thereby, a further high cleaning effect can be obtained, because of both a mechanical action due to abrasion and a chemical action due to the cleaning component.

Alternatively, a film 22A may be separately formed, and twisted together with a cord-shaped cleaning substrate 21 as shown in FIG. 9. In other words, in the cleaning substrate 21 shown in FIG. 7(*b*), one of the water-disintegrable sheet 26 and the water-disintegrable paper 25 may be the layer (film) 22A containing the cleaning component. Moreover, in the cleaning substrate 21 shown in FIG. 7(*c*), the water-disintegrable sheet 25 may be the layer (film) 22A containing the cleaning component.

The layer 22A containing the cleaning component is preferably formed on the cleaning substrate 21 at a portion to be brought into contact with a part to be cleaned, and further preferably formed in a front end portion of the cleaning substrate 21. As described above, the cleaning component is easily placed locally in any place, whereby efficient cleaning can be performed. As a result, the cleaning component is used in a less amount than that used in a case where a liquid detergent is sprayed directly and used, whereby an effect of reducing load on wastewater environment can also be expected.

Next, a specific method of using the cleaning tool 1 will be described, with a case where the cleaning tool 1 is a cleaning tool for a toilet taken as an example.

While the bundling portion 3 of the cleaning tool 1 shown in FIG. 8 or FIG. 10 is held between the containing portion 12 and the pressing portion 13 of the holder 10 shown in FIG. 1 or FIG. 6, cleaning is performed by scrubbing the inside of a toilet bowl of a water flush toilet with the cleaning unit 2. At this time, the layers 22A containing the cleaning component formed in the cleaning unit 2 is mechanically broken, and hence the cleaning component is released. Thereby, stain can be effectively removed. Meanwhile, suppose a case where the layer-forming material of the layer (film) 22A containing the cleaning component is water-soluble or water-disintegrable, and wiping is performed with the cleaning unit 2 wetted with wash water in a water flush toilet. In such a case, the film 22A is broken, and the cleaning component is released. Thereby, stain can be effectively removed.

After cleaning, when the pressing portion 13 of the holder 10 is detached from the containing portion 12, the cleaning unit 2 together with the bundling portion 3 falls into the water flush toilet, and can be flushed down with wash water without any treatment. The fixing force of the bundling portion 3 is released in water, and the cleaning unit 2 is dispersed as individual cleaning substrates 21. For this reason, the cleaning unit 2 flows through piping without clogging. Then, the individual cleaning substrates 21 are disintegrated into separate fibers in the piping or a septic tank.

The cleaning tool 1 of the present invention can widely be applied to cleaning tools 1 provided with a water-disintegrable cleaning unit 2.

EXAMPLES

Hereinafter, the present invention will be described more specifically on the basis of Examples; however the present invention is not limited to these Examples. Unless otherwise noted, % below means % by weight.

Example 1

To 20 ml of cyclohexane containing 6% of sorbitan trioleate (span 85), 3 ml of a 25% gelatin aqueous solution, and 2 ml of a cleaning component aqueous solution containing 0.8% of glycolic acid and 7% of an alkylamine oxide (an N,N-dimethyldodecylamine N-oxide solution manufactured by Wako Pure Chemical Industries, Ltd.) were added, followed by stirring at 500 rpm for 10 minutes. To this mixture, 20 ml of a cyclohexane solution containing 1% of terephthaloyl dichloride was added. After stirring at a constant speed (500 rpm) for 20 minutes, the mixture was left to stand at 10° C. or below for 12 hours. The obtained microcapsules 22 were isolated by filtration, and then washed with cyclohexane.

By use of 2-propanol, excessive water in membranes of the microcapsules was removed, and thus microcapsules 22 encapsulating the cleaning component were obtained. A particle diameter of the capsules (determined with a profile projector V-12 manufactured by NIKON CORPORATION) was from approximately 100 to approximately 1000 μm.

The obtained microcapsules 22 were held on paper cords (cleaning substrates 21) which had been formed of a water-disintegrable wet-laid nonwoven fabric (manufacturer: Kokko Paper Mfg. Co., Ltd., having a disintegration time in water according to JIS P4501 of 500 seconds) and which had a length of 18 cm by the following method. Specifically, by use of a mesh having a pore diameter of 50 μm, the microcapsules 22 were filtered for removal of 2-propanol. Then, a PVA aqueous solution (2%) was spray coated onto front end portions of the cleaning substrates, and then the microcapsules were scattered on the coated portions. Thereafter, by drying in an oven at 105° C., the microcapsules 22 were fixed to the cleaning substrates 21. The amount of the microcapsules 22 held (attached) was 5% relative to a weight of the substrate.

Example 2

To 20 ml of cyclohexane (containing 6% of span 85), 3 ml of a 25% gelatin aqueous solution and 2 ml of purified water was added, followed by a 10 minute stirring. Thus, a W/O emulsion was prepared. To this emulsion, 10 ml of a cyclohexane solution containing 1% of terephthaloyl dichloride was added. After stirred at a constant speed (500 rpm) for 20 minutes, the mixture was cooled overnight at 10° C. or below. Excessive terephthaloyl dichloride was removed with cyclohexane, and then washing with purified water was performed. These microcapsules 22 were immersed in a cleaning component aqueous solution containing 0.8% of glycolic acid and 7% of alkylamine oxide. Then, by addition of isopropanol, excessive water in the membrane of the microcapsules was removed. Thus, microcapsules 22 encapsulating the cleaning component (particle diameter: approximately 100 to approximately 1000 μm) were obtained.

These microcapsules 22 were held on cleaning substrates 21 by a method similar to that in Example 1, whereby the cleaning substrates 21 having the microcapsules 22 attached thereto were obtained.

Example 3

To 20 ml of cyclohexane (containing 6% of span 85), 3 ml of a 25% gelatin aqueous solution and 2 ml of purified water were added, followed by a 10 minute stirring. Thus, a W/O emulsion was prepared. To this emulsion, 10 ml of a cyclohexane solution containing 1% of terephthaloyl dichloride was added. After stirred at a constant speed (500 rpm) for 20 minutes, the mixture was cooled overnight at 10° C. or below. Excessive terephthaloyl dichloride was removed with cyclohexane, and then washing with purified water was performed. These microcapsules 22 were immersed in a solution obtained by diluting the cleaning component aqueous solution (containing 0.8% of glycolic acid and 7% of alkylamine oxide) used in Example 2 two-fold. Then, by use of isopropanol, excessive water in the membranes of the microcapsules was removed. Thus, microcapsules 22 encapsulating the cleaning component (particle diameter: approximately 100 to approximately 1000 μm) were obtained.

These microcapsules 22 were held on cleaning substrates 21 by a method similar to that in Example 1, whereby the cleaning substrates 21 having the microcapsules 22 attached thereto were obtained.

Comparative Example 1

Cleaning substrates for comparison were prepared as follows. Specifically, paper cords which had been formed of a water-disintegrable wet-laid nonwoven fabric (the same as those in Example 1) and which had a length of 18 cm was immersed in the cleaning component aqueous solution used in Example 1, and thereby directly impregnated with the cleaning component aqueous solution, followed by drying at 105° C.

(Release Test of Cleaning Component)

The microcapsules 22 produced in Examples 1 to 3 were subjected to a release test of the cleaning component as follows.

In 10 ml of purified water, 0.2 g of the microcapsules were immersed and allowed to stand for 10 minutes, followed by centrifugation. The supernatant was subjected to liquid chromatography for determination of the concentration of glycolic acid. Thus, release ability of the cleaning component was evaluated.

Analysis conditions of the liquid chromatography were as follows.

Column: Shim-pack SPR-H (Shimazu, 250 mm×7.6 mm)

Column temperature: 60° C.

Mobile phase: $HClO_4$ (pH 2.1)

Flow rate: 0.5 mL/min

Detector: UV 210 nm

Table 1 shows the concentration of glycolic acid released.

TABLE 1

| | Released amount (ppm) |
|---|---|
| Example 1 | 8.12 |
| Example 2 | 27.11 |
| Example 3 | 9.16 |

As apparent from Table 1, it was observed in Examples 1 to 3 that glycolic acid, which was the cleaning component, was released. In Example 2, the released amount was particularly large.

(Degradation Test of Substrate)

The cleaning substrates formed in Examples 1 to 3 and Comparative Example 1 were subjected to experiments based on the wet method in JAPAN TAPPI No 50/1 "paper and board—accelerated ageing", and degradation ratios of the substrates were calculated.

$$\text{Degradation ratio of substrate}=[(\text{initial value}-\text{strength after 48 hours})/(\text{initial value})]\times 100$$

Table 2 shows the results.

TABLE 2

| | Basic degradation ratio (%) |
|---|---|
| Example 1 | −10.03 |
| Example 2 | −8.52 |
| Example 3 | −12.14 |
| Comparative Example 1 | 78.65 |

In Examples, the strength of the substrates was retained, and a state of increased strength was kept because of an effect of coating of the binder. In contrast, in Comparative Example, deterioration in strength of the substrate was significant, and change in color of the paper cord was observed. Accordingly, it was found that by making microcapsules of the cleaning component, the degradation of the water-disintegrable substrates due to the cleaning component is suppressed.

Next, 40 cleaning substrates 21 (paper cords) which were produced in each of Example 1 to 3 and which had the microcapsules 22 attached thereto were bundled, and end faces on one side thereof were wound with a water-disintegrable paper and fixed. Thereby, each brush-like cleaning tool was produced.

For comparison, a cleaning tool for comparison was similarly produced by use of cleaning substrates 21 which was the same as those in Examples but which held no microcapsules 22.

By use of these cleaning tools, actual cleaning tests were conducted. A stain composition containing 1% of milk casein, 5% of tricalcium phosphate, 1% of uric acid, 2% of urea, and 91% of ion-exchanged water was prepared. This stain composition was cast coated onto tiles, and dried to solidify in an atmosphere of 60° C. for 24 hours. Thus, model stain was obtained. The tiles to which the model stain was attached were scrubbed by use of the above-obtained cleaning tools, respectively, for 3 minutes. Thus, cleaning effect was checked. As a result, the cleaning tools 1 of the examples released the cleaning component, and exhibited a better cleaning effect than the cleaning tool for comparison.

Example 1A

To an aqueous solution containing 0.8% of glycolic acid and 7% of alkylamine oxide (an N,N-dimethyldodecylamine N-oxide solution manufactured by Wako Pure Chemical Industries, Ltd.), chitosan was added in such an amount to be 0.5%, and dissolved by heating at 50° C. Into a petri dish (having a diameter of 10 cm), 10 g the obtained solution (a layer-forming solution 1) was added, and dried at 105° C. Thus, each film 22A (a layer containing the cleaning component) having a thickness of 67.3 μm was obtained.

Example 2A

Each film 22A (a layer containing the cleaning component) having a thickness of 188 μm was obtained similarly to Example 1A, except that chitosan was added in such an amount to be 1% to obtain a solution (a layer-forming solution 2).

Example 3A

Paper cords (cleaning substrates 21) which had been formed of a water-disintegrable wet-laid nonwoven fabric (manufacturer: Kokko Paper Mfg. Co., Ltd., having a disintegration time in water according to JIS P4501 of 500 seconds) and which had a length of 18 cm were immersed in the layer-forming solution 1 of Example 1A, and dried at 105° C. Thus, the cleaning substrates 21 having the film 22A attached thereto were obtained. The films 22 formed had a thickness of 9 μM.

Example 4A

Cleaning substrates 21 having films 22A attached thereto were obtained similarly to Example 3A by use of the layer-forming solution 2 of Example 2A. The films 22A formed had a thickness of 7.4 μm.

Comparative Example 1A

An aqueous solution containing 0.8% of glycolic acid and 7% of alkylamine oxide was prepared. Therein, the same cords as in the above-described Examples were immersed, and dried. Thus, cleaning substrates 21 impregnated with the cleaning component were obtained.

(Release Test of Cleaning Component)

Each of the films 22A and each of the cleaning substrates 21 having the films 22A attached thereto produced in Examples were subjected to release test of the cleaning component as follows.

In 30 ml of purified water, 10 g of the film or the cleaning substrate 21 (the paper cord of 18 cm) having the film 22A attached thereto was immersed, and allowed to stand for 10 minutes, followed by centrifugation. The supernatant was subjected to liquid chromatography for determination of the concentration of glycolic acid. Thus, release ability of the cleaning component was evaluated.

Column: Shim-pack SPR-H (Shimazu, 250 mm ×7.6 mm)

Column temperature: 60° C.

Mobile phase: HClO4 (pH 2.1)

Flow rate: 0.5 mL/min

Detector: UV 210 nm Table 3 shows the concentration of glycolic acid released. [Table 3]

TABLE 3

| | Released amount (ppm) |
|---|---|
| Example 1 (film) | 380.83 |
| Example 2 (film) | 155.81 |
| Example 3 (paper cord) | 671.56 |
| Example 4 (paper cord) | 383.71 |
| Comparative Example 1 (paper cord) | 305.25 |

As apparent from Table 3, it was observed in Examples that glycolic acid, which was the cleaning component, was released.

The released amount from the film 22A of Example 1A and the released amount from the paper cord in Example 3A were particularly large. Accordingly, it was found that the released amount of the cleaning component was successfully controlled by adjustment of the concentration of the layer-forming material. Since no chitosan was added in Comparative Example 1A, it is conceivable that the amount of the cleaning component fixed to the paper cords was small. In other words, it is conceivable that chitosan has a high performance of retaining the cleaning component.

As Reference Example 1A, film formation was performed such that the concentration of chitosan was 2%.

By use of this film 22A, a release test of glycolic acid was performed similarly to the above-described Examples, but no release was observed. Moreover, it was observed that when the concentration of chitosan exceeded 2%, the solubility of chitosan in water was lowered.

As Reference Example 2A, film formation was attempted such that the concentration of chitosan was 0.1%, but it was difficult to form and retain a film 22A.

As Reference Example 3A, to an aqueous solution containing 7% of alkylamine oxide alone, with no glycolic acid added thereto, chitosan was added at such a concentration to be 1%, followed by heating at 50° C. However, no chitosan was dissolved. This is because chitosan dissolves in only an acidic solution. Accordingly, it was found that if no acidic substance, such as glycolic acid, is blended, a film based on chitosan is not broken, even when the membrane is brought into contact with water at the time of toilet cleaning.

(Degradation Test of Substrate)

The cleaning substrates 21 formed in Examples 3A to 4A and Comparative Example 1A were subjected to experiments based on the wet method in JAPAN TAPPI No 50/1 "paper and board—accelerated ageing", and degradation ratios of the substrates were calculated.

Degradation ratio of substrate=[(initial value−strength after 48 hours)/(initial value)]×100

Table 4 shows the results. [Table 4]

TABLE 4

| | Degradation ratio of substrate (%) |
|---|---|
| Example 3 | 15.89 |
| Example 4 | 1.68 |
| Comparative Example 1 | 78.65 |

In Examples, it was found out that the strength of the cleaning substrates 21 was retained, and particularly that the higher the chitosan concentration became, the more the substrate degradation ratio was reduced (the more the strength of the substrate is retained). In contrast, in the comparative example, deterioration in strength of the cleaning substrate 21 was significant, and change in color of the paper cords was observed. Accordingly, it was found that by forming a film of the cleaning component, the degradation of the water-disintegrable substrate due to the cleaning component is suppressed.

Next, 40 cleaning substrates 21 (paper cords) which were produced in each of Examples 3A to 4A and which had the chitosan films 22 A attached thereto were bundled, and end faces on one side thereof were wound with a water-disintegrable paper and fixed. Thereby, each brush-like cleaning tool was produced.

For comparison, a cleaning tool for comparison was similarly produced by use of cleaning substrates 21 which was the same as those in Examples but which held no chitosan film.

By use of these cleaning tools 1, actual cleaning tests were conducted. A stain composition containing 1% of milk casein, 5% of tricalcium phosphate, 1% of uric acid, 2% of urea, and 91% of ion-exchanged water was prepared. This stain composition was cast coated onto tiles, and dried to solidify in an atmosphere of 60° C. for 24 hours. Thus, model stain was obtained. The tiles to which the model stain was attached was scrubbed by use of the above-obtained cleaning tools 1, respectively, for 3 minutes. Thus, cleaning effect was checked. As a result, the cleaning tools 1 of the examples released the cleaning component, and exhibited a better cleaning effect than the cleaning tool for comparison.

Industrial Applicability

As has been described above, a cleaning tool according to the present invention releases a cleaning component at the time of use, when microcapsules held on a cleaning substrate or a layer containing a cleaning component is physically and/or chemically broken. Accordingly, it is not necessary to spray a detergent separately, and hence cleaning can be performed with the cleaning tool alone. Thus, there is no danger of splash of a detergent or the like, and cleaning can be conducted simply and easily. Moreover, since the cleaning substrate is water-disintegrable and dispersible in water, a cleaning unit can simply be disposed of by being flushed down a toilet without any treatment after completion of cleaning, and thus hygiene is achieved.

Note that since encapsulated in microcapsules, the cleaning component is not brought into direct contact with the skin of the user at the time of using the cleaning tool, thereby providing safety. Moreover, by making the microcapsules of the cleaning component, the water-disintegrable cleaning substrate is not brought into contact with the cleaning component, the cleaning component can be held, while the degradation of the cleaning substrate is avoided. As a result, a strong component with a high washing performance can be held, and a high cleaning effect can be obtained.

Alternatively, the cleaning component is contained in a layer. Hence, the cleaning component is not brought into direct contact with the skin of the user at the time of using the cleaning tool, thereby providing safety. Moreover, by forming the layer (film) containing the cleaning component, that is, by using the cleaning component in a form of a film, the water-disintegrable cleaning substrate is not brought into contact with the cleaning component. Hence, the cleaning component can be held, while the deterioration of the cleaning substrate is avoided. As a result, a strong component with a high cleaning performance can be held, and a high cleaning effect can be obtained.

The invention claimed is:

1. A cleaning tool comprising a cleaning unit including a water-disintegrable cleaning substrate which is dispersible in water, and which holds microcapsules encapsulating a cleaning component, wherein a membrane material of the microcapsule is water-soluble or water-disintegrable;

a disintegrating time in water of the cleaning substrate measured in accordance with JIS P4501 is from 180 to 600 seconds; and a disintegrating time in water of the membrane material measured in accordance with JIS P4501 is 30 seconds or less.

2. The cleaning tool according to claim 1, further comprising a bundling portion.

3. The cleaning tool according to claim 2, wherein a holder configured to attachably and detachably hold the bundling portion is provided.

4. The cleaning tool according to claim 3, wherein the cleaning component includes an organic acid and a cationic surfactant.

5. The cleaning tool according to claim 2, wherein the cleaning component includes an organic acid and a cationic surfactant.

6. The cleaning tool according to claim 2, wherein most of the microcapsules are distributed in a front end portion of the cleaning substrate more than an end portion on a side of the bundling portion.

7. The cleaning tool according to claim 1, wherein the cleaning component includes an organic acid and a cationic surfactant.

8. The cleaning tool according to claim 7, wherein the cleaning tool is a cleaning tool for a toilet.

9. The cleaning tool according to claim 1, wherein the cleaning substrate is formed of a plurality of cords; and the plurality of cords are adhered to each other with a water-soluble adhesive.

10. A cleaning tool comprising a cleaning unit including: a water-disintegrable cleaning substrate which is dispersible in water; and a layer containing a cleaning component, wherein a layer-forming material for forming the layer is water-soluble or water-disintegrable;

a disintegrating time in water of the cleaning substrate measured in accordance with JIS P4501 is from 180 to 600 seconds; and a disintegrating time in water of the layer-forming material measured in accordance with JIS P4501 is 30 seconds or less.

11. The cleaning tool according to claim 10, wherein the cleaning component includes an organic acid and a cationic surfactant.

12. The cleaning tool according to claim 10, wherein only a front end portion of the cleaning substrate is immersed in the layer-forming material.

13. The cleaning tool according to claim 10, wherein the layer containing a cleaning component is formed of a film which is separate from the cleaning substrate; and the cleaning substrate is arranged outside the film.

14. The cleaning tool according to claim 10, wherein the cleaning substrate is formed of a plurality of cords; and the plurality of cords are adhered to each other with a water-soluble adhesive.

15. The cleaning tool according to claim 10, further comprising a bundling portion.

16. The cleaning tool according to claim 15, wherein a holder configured to attachably and detachably hold the bundling portion is provided.

17. The cleaning tool according to claim 16, wherein the cleaning component includes an organic acid and a cationic surfactant.

18. The cleaning tool according to claim 15, wherein the cleaning component includes an organic acid and a cationic surfactant.

* * * * *